US009267663B2

(12) United States Patent
Arai

(10) Patent No.: US 9,267,663 B2
(45) Date of Patent: Feb. 23, 2016

(54) ILLUMINATION DEVICE

(75) Inventor: Shigeru Arai, Tokyo (JP)

(73) Assignee: JAPAN APPLIED OPTICS CO., LTD., Tokyo (JP)

( * ) Notice: Subject to any disclaimer, the term of this patent is extended or adjusted under 35 U.S.C. 154(b) by 363 days.

(21) Appl. No.: 13/814,845

(22) PCT Filed: Jun. 8, 2011

(86) PCT No.: PCT/JP2011/063172

§ 371 (c)(1),
(2), (4) Date: Feb. 7, 2013

(87) PCT Pub. No.: WO2012/020597

PCT Pub. Date: Feb. 16, 2012

(65) Prior Publication Data

US 2013/0135856 A1 May 30, 2013

(30) Foreign Application Priority Data

Aug. 12, 2010 (JP) ..... 2010-181004
Aug. 12, 2010 (JP) ..... 2010-181005
Jan. 18, 2011 (JP) ..... 2011-007994

(51) Int. Cl.
*F21V 9/00* (2015.01)
*F21S 10/02* (2006.01)
(Continued)

(52) U.S. Cl.
CPC . *F21V 9/00* (2013.01); *F21S 10/02* (2013.01); *F21V 5/04* (2013.01); *F21V 7/0091* (2013.01);
(Continued)

(58) Field of Classification Search
CPC ..... F21V 5/007; F21V 7/0091; F21V 5/043; F21V 5/008; F21V 13/04; F21V 17/00; F21V 17/16; F21V 17/162; F21V 17/164; F21V 14/166; F21V 17/168; F21V 17/18; F21V 9/00; F21V 29/773; F21V 14/08; F21V 5/04; F21V 29/004; F21V 14/06; F21V 17/12; G02B 5/0215; G02B 5/021; G02B 5/0231; G02B 5/02; F21W 2131/406; F21W 2131/304; F21S 17/16; F21S 17/162; F21S 17/164; F21S 17/166; F21S 17/168; F21S 17/1821; F21S 17/18; F21S 8/02; F21S 10/02; F21Y 2105/003; F21Y 2113/002; F21Y 2101/02; F21Y 2113/005
USPC ..... 362/245, 331, 333, 231, 362, 440, 362/147–148, 308–309, 364, 455
See application file for complete search history.

(56) References Cited

U.S. PATENT DOCUMENTS 2,878,374 A * 3/1959 Sleichert et al. ..... 362/455
4,839,783 A * 6/1989 Arai ..... 362/374
(Continued)

FOREIGN PATENT DOCUMENTS

DE 10 2007 043 192 3/2009
JP 08-007629 1/1996
(Continued)

OTHER PUBLICATIONS

JP 2010-181004, Decision to Grant from JPO, dated Aug. 5, 2014 along with an english translation thereof.
(Continued)

*Primary Examiner* — Diane Lee
*Assistant Examiner* — Naomi M Wolford
(74) *Attorney, Agent, or Firm* — Greenblum & Bernstein, P.L.C.

(57) ABSTRACT

Light having little color inconsistency is effectively emitted with a simple structure achieving favorable productivity. A plurality of multi-color light emitting diodes comprising a plurality of LED chips having different light emission colors is disposed on the same surface such that the light emitted by the plurality of the multi-color light emitting diodes is mixed and emitted in a illumination device, wherein at least one multi-color light emitting diode from among the plurality of multi-color light emitting diodes is disposed while being rotated by a prescribed angle with reference to one other multi-color light emitting diode in such a manner that when translating the one multi-color light emitting diode so as to overlap with the one other multi-color light emitting diode, LED chips having the same light emission color do not overlap with each other.

5 Claims, 13 Drawing Sheets

(51) Int. Cl.

| | |
|---|---|
| ***F21V 29/00*** | (2015.01) |
| ***F21V 5/04*** | (2006.01) |
| ***F21V 7/00*** | (2006.01) |
| ***F21V 14/02*** | (2006.01) |
| ***F21V 14/06*** | (2006.01) |
| ***F21V 14/08*** | (2006.01) |
| ***F21V 17/12*** | (2006.01) |
| ***F21V 17/16*** | (2006.01) |
| ***F21V 29/77*** | (2015.01) |
| *F21W 131/406* | (2006.01) |
| *F21Y 101/02* | (2006.01) |
| *F21Y 113/00* | (2006.01) |
| *F21W 131/304* | (2006.01) |
| *F21V 5/00* | (2015.01) |
| *F21Y 105/00* | (2006.01) |

(52) U.S. Cl.

CPC ..... *F21V 14/02* (2013.01); *F21V 14/06* (2013.01); *F21V 14/08* (2013.01); *F21V 17/12* (2013.01); *F21V 17/164* (2013.01); *F21V 29/004* (2013.01); *F21V 29/773* (2013.01); *F21V 5/008* (2013.01); *F21W 2131/304* (2013.01); *F21W 2131/406* (2013.01); *F21Y 2101/02* (2013.01); *F21Y 2105/003* (2013.01); *F21Y 2113/002* (2013.01); *F21Y 2113/005* (2013.01)

(56) References Cited

U.S. PATENT DOCUMENTS

| | | | | |
|---|---|---|---|---|
| 5,211,473 | A * | 5/1993 | Gordin et al. | 362/297 |
| 5,752,766 | A * | 5/1998 | Bailey et al. | 362/249.04 |
| 6,048,081 | A | 4/2000 | Richardson | |
| 6,367,949 | B1 * | 4/2002 | Pederson | B60Q 1/2611 362/240 |
| 2008/0123057 | A1 * | 5/2008 | Williamson | 353/30 |
| 2008/0291677 | A1 * | 11/2008 | Chen | 362/249 |
| 2008/0304536 | A1 | 12/2008 | Gold et al. | |
| 2010/0008062 | A1 * | 1/2010 | Chang | 362/97.1 |

FOREIGN PATENT DOCUMENTS

| | | |
|---|---|---|
| JP | 2000-30506 | 1/2000 |
| JP | 2001-307502 | 11/2001 |
| JP | 2006-079991 | 3/2006 |
| JP | 2006-128217 | 5/2006 |
| JP | 2008-047809 | 2/2008 |
| JP | 2009-004276 | 1/2009 |
| JP | 2009-545854 | 12/2009 |
| JP | 2010-073654 | 4/2010 |
| JP | 2010-511269 | 4/2010 |
| WO | 2008/016900 | 2/2008 |

OTHER PUBLICATIONS

JP 2010-181004, Office Action from JPO, dated May 20, 2014 along with an english translation thereof.

JP 2010-181005, Office Action from JPO, dated May 20, 2014 along with an english translation thereof.

JP 2010-181005, Decision to Grant from JPO, dated Aug. 5, 2014 along with an english translation thereof.

Extended European Search Report for EP 11 81 6263.5 having a mailing date of Oct. 19, 2015.

* cited by examiner

ILLUMINATION DEVICE

FIELD OF THE INVENTION

The present invention relates to an illumination device having a multi-color light emitting diode as a light source.

BACKGROUND OF THE INVENTION

Conventionally, as an illumination device there is a type of lighting equipment called "wall washer", which radiates a lot of light onto a wall or the like (for example, see patent literature 1). Further, a spotlight is included in the illumination device, which is to illuminate a specific area (spot) in a focused manner to attract an audience's attention in a theater and so forth.

Conventionally, a halogen lamp has been often used as a light source for such illumination devices. However, in recent years, an LED is increasingly used in accordance with the request for long operating life, energy saving and so forth. In particular, in an illumination device employing as a light source a multi-color light emitting diode (full color light emitting diode included), which is constituted by a plurality of LED chips with mutually different light emitting colors, various colors can be created and further, for example color temperature and color tone can be changed as well by changing the output of each LED chip.

However, since the multi-color light emitting diode generally includes LED chips such as R (red) chip, G (green) chip, and B (blue) chip, which are housed in a single package to form a resin molded structure as a whole (for example, see patent literature 2), even when white light emission is intended to be created by using RGB color mixing, the RGB color light cannot be well mixed and may be individually seen as respective colors of R, G and B. Further, due to the separation of the light emission colors as described above, color inconsistency may unfavorably occur in the light irradiated onto an object to be irradiated.

Further in a conventional spotlight, a plurality of light emitting diodes is obliquely disposed on a curved surface and irradiation light from each light emitting diode is concentrated on one point to form a virtual single point light source unit, and the light emitted from the light source unit is guided to pass through an aperture to radiate (for example, see patent literatures 3 and 4).

In such a spotlight, although undiffused light is preferably created by using an aperture having the smallest possible size of hole in order to effectively irradiate a certain area (spot) with the light emitted from a light source, if there is less diffusion, the mixture of light becomes insufficient, which may cause color inconsistency to occur more easily. As such, although a lens can be provided to facilitate mixture, the configuration is inefficient.

Specifically, in the aforementioned spotlight, in order to focus on one point the irradiation light from the plurality of light emitting diodes, each light emitting diode is obliquely fixed so as to incline the optical axis of the irradiation light from each light emitting diode. For this purpose, an inclined plane or a curved surface needs to be formed for a substrate for attaching a light emitting diode thereto and a heat sink for dissipating heat from a light emitting diode, and the process is not easy.

Further, such as when irradiating pictures exhibited in a museum, depending on pictures vertically long or horizontally long, in order to efficiently irradiate an object to be irradiated in the longitudinal direction thereof with light having little color inconsistency, it is desired to make changeable a degree of light diffusion in the vertical and horizontal directions in accordance with an object to be irradiated.

RELATED ART

Patent Literature

PATENT LITERATURE 1: UNEXAMINED JAPANESE PATENT APPLICATION PUBLICATION HEI 8-7629
PATENT LITERATURE 2: UNEXAMINED JAPANESE PATENT APPLICATION PUBLICATION 2008-47809
PATENT LITERATURE 3: UNEXAMINED JAPANESE PATENT APPLICATION PUBLICATION 2006-79991
PATENT LITERATURE 4: UNEXAMINED JAPANESE PATENT APPLICATION PUBLICATION 2001-307502

SUMMARY OF THE INVENTION

Problems to be Solved by the Invention

The present invention has been created in view of the above-mentioned conventional circumstances, and the problem of the present invention is to provide an illumination device capable of effectively radiating the light emitted by a plurality of multi-color light emitting diodes with a simple structure generating favorable productivity.

Means for Solving the Problems

A technical means for solving the above-mentioned problem is to provide an illumination device for mixing and radiating the light emitted by a plurality of multi-color light emitting diodes, wherein the illumination device is provided with first lenses disposed correspondingly to each of said plurality of multi-color light emitting diodes in contact with or in the proximity of the front side thereof and a second lens disposed on the front side of the plurality of first lenses, and said second lens has on the rear surface a corrugated sheet-like unevenly profiled portion formed by disposing a plurality of rows of recessed portions with concave shaped cross-section continuing in one direction in such a way that the degree of diffusion when light incident from the rear surface side is diffused and radiated from the front surface is set to be larger in the direction orthogonal to the direction in which said unevenly profiled portion continues on the rear surface than in the direction in which said unevenly profiled portion continues, and the second lens is provided to rotate said unevenly profiled portion around the optical axis.

Advantage of the Invention

The present invention configured as described above produces an effect shown below.

The direction in which the degree of light diffusion increases can be changed by rotating the second lens. Thus, it is possible to effectively radiate the light emitted by a plurality of multi-color light emitting diodes with a simple structure generating favorable productivity.

DESCRIPTION OF THE INVENTION

Figure 1:
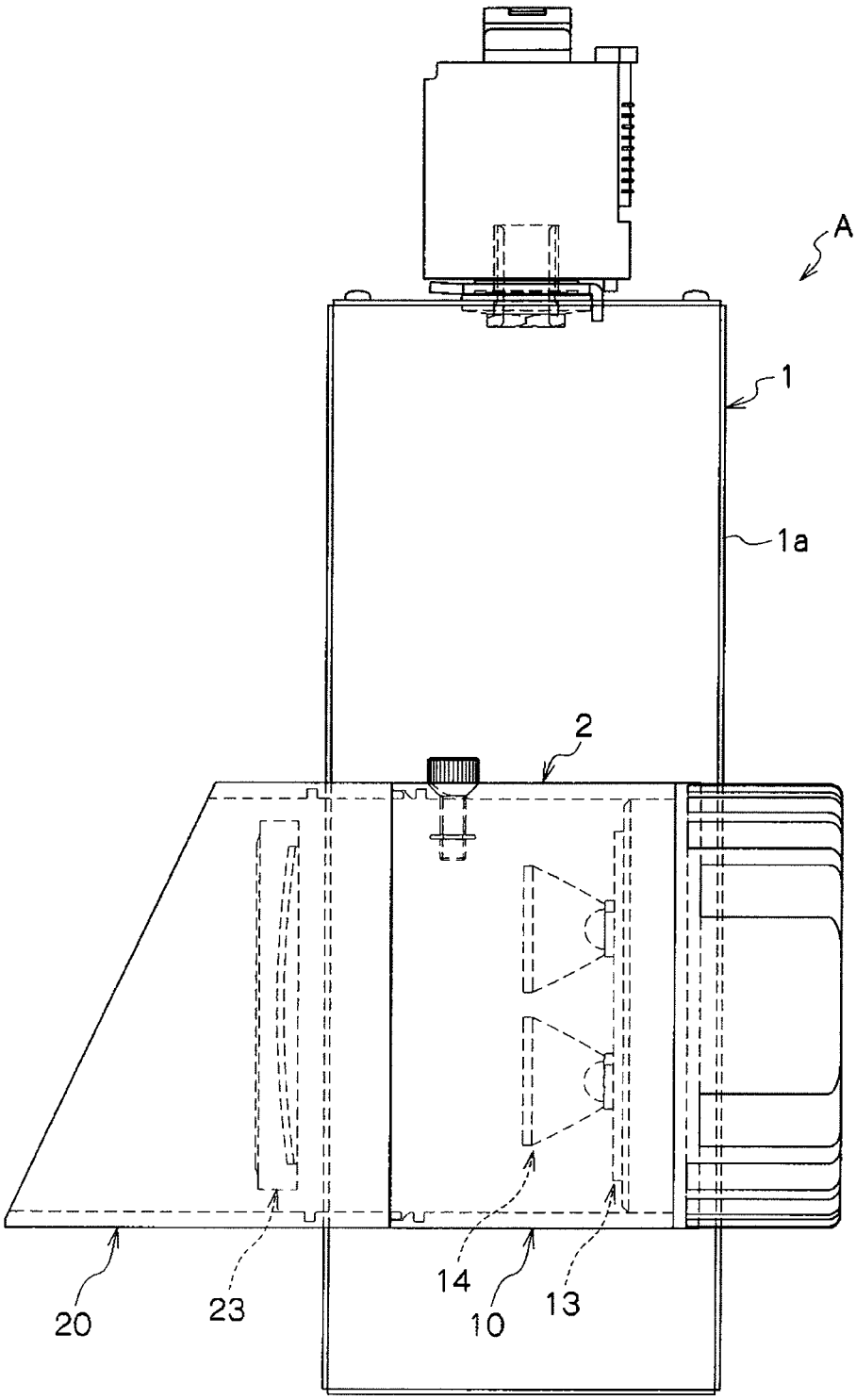
FIG. 1 is a side view illustrating an embodiment 1 of an illumination device according to the present invention.

According to an embodiment for practicing the present invention, an illumination device has a plurality of multi-color light emitting diodes comprising a plurality of LED chips with different light emission colors disposed on the same surface such that the light emitted by the plurality of the multi-color light emitting diodes is mixed and emitted, wherein at least one multi-color light emitting diode from among the plurality of the multi-color light emitting diodes is disposed while being rotated by a prescribed angle with reference to one other multi-color light emitting diode in such a manner that when translating said one multi-color light emitting diode so as to overlap with said one other multi-color light emitting diode, LED chips having the same light emission color do not overlap with each other.

According to such a configuration, it is possible to reduce color inconsistency and so on, which is generated when the light emitted by LED chips having the same light emission color overlaps with each other and increases the intensity.

Here, in a preferable configuration of said multi-color light emitting diodes, a plurality of LED chips with different light emission colors are disposed on the same circumference.

Further, in a preferable configuration of said multi-color light emitting diodes, n of said plurality of multi-color light emitting diodes are disposed on the same circumference at regular intervals and each multi-color light emitting diode is disposed while being rotated by 360/n degrees with respect to the circumferentially adjoining multi-color light emitting diodes.

Further, in a preferable configuration, four multi-color light emitting diodes are provided and each of the multi-color light emitting diodes has LED chips with four colors of red, green, blue and white disposed on the same circumference at regular intervals such that each multi-color light emitting diode is disposed while being rotated by 90 degrees with respect to the circumferentially adjoining multi-color light emitting diodes.

Still further, in a preferable configuration, provided are a substrate for fixing in the same plane said plurality of multi-color light emitting diodes in such a manner that each of said plurality of multi-color light emitting diodes faces the front, a body for covering the sides of said plurality of multi-color light emitting diodes and said substrate, a heat sink disposed on the rear side of said substrate for dissipating the heat of said plurality of multi-color light emitting diodes, a first lens disposed in contact with or in the proximity of the front side of said plurality of multi-color light emitting diodes corresponding to each of the multi-color light emitting diodes, a second lens disposed on the front side of the plurality of first lenses, and a support bracket for supporting said plurality of first lenses while fixing the same to said substrate.

Further, in another preferable configuration, said first lens inclines the optical axis thereof with respect to the center axis of said corresponding multi-color light emitting diode.

According to the configuration, the optical axis of the irradiation light from the light emitting diode can be inclined by a simple structure generating preferable productivity.

This configuration, even if constituted as an independent invention without including above described elements, can produce the above-mentioned effect. That is, the independent invention is provided with a light emitting diode and a lens disposed on the front side of the light emitting diode in contact with or in the proximity of the light emitting diode, and said lens is disposed such that the optical axis thereof is inclined with respect to the center axis of said light emitting diode. Here, said light emitting diode includes a multi-color light emitting diode and a single-color light emitting diode.

Further, in a preferable configuration, said first lens has on the incidence side a recessed portion for inserting a lens section of each of said multi-color light emitting diodes while having a substantially flat part with respect to said substrate on the outer surface at the edge side of said recessed portion.

Further in a preferable configuration, said first lens is configured such that said first lens totally reflects at least a part of the light which is incident from said corresponding multi-color light emitting diode and concentrates the reflected light on the front side of the first lens.

Yet further in a preferable configuration, an aperture is provided such that the light emitted from said plurality of first lenses passes there through, and each of said plurality of first lenses has the optical axis inclined in such a manner that the outgoing light therefrom is directed to the opening in the center side of said aperture.

Still further in a preferable configuration, said second lens is a diffusing lens which has different degrees of light diffusion between the vertical direction and horizontal directions and is provided rotatably around the optical axis.

According to such a configuration, it is possible to emit the light having little color inconsistency, which has different degrees of light diffusion between the vertical direction and the horizontal direction, and further it is possible to easily change the direction in which said degree of light diffusion is increased by adjusting the rotational position of the second lens, and thus the light having little color inconsistency can be effectively emitted in accordance with an object to be irradiated.

Further, this configuration, even if constituted as an independent invention without including above described elements, can produce the above-mentioned effect. That is, the independent invention is an illumination device comprising a multi-color light emitting diode having LED chips with a plurality of different light emission colors and a lens for mixing the light emitted from the multi-color light emitting diode, and said lens is formed such that degrees of light diffusion are different between the vertical direction and the horizontal direction while being configured such that the lens is rotatable around the optical axis thereof.

Further, in a preferable configuration, a hood is provided to substantially cylindrically cover the front side of said second lens and said hood has a shape such that the front end part is obliquely cut and is provided rotatably around the optical axis of said second lens.

Further, in a preferable configuration, provided is an illumination device which connects a front cylindrical portion having said second lens and said hood with a rear cylindrical portion having said multi-color light emitting diode and said first lens, wherein said front cylindrical portion is provided with a combining cylindrical portion detachably connected with said rear cylindrical portion, said hood extended over the periphery of the combining cylindrical portion, said second lens rotatably provided inside the combining cylindrical portion at the front end side thereof, and a frame shaped spring member provided on the rear side of said second lens inside the combining cylindrical portion, and an inward edge portion inwardly folded to contact the second lens from the front side is provided at the front edge of said combining cylindrical portion, and an annular groove continuing throughout the circumference is formed on the inner peripheral surface of said hood, and said frame shaped spring member has one part and one other part opposing said one part in the outer periphery respectively, each of which passes through said combining cylindrical portion to fit in said annular groove, and thereby said frame shaped spring member is latched with said combining cylindrical portion such that said frame shaped spring member elastically presses said second lens from the rear side while holding said hood rotatably and unmovably in the back-and-forth direction.

Hereinafter, an embodiment specifying the above configuration is described on the basis of the drawings.

Embodiment 1

FIG. 1 shows an embodiment 1 of an illumination device according to the present invention.

The illumination device A is wall washer type illumination equipment comprised of a control circuit section 1 and a body 2 connected with the lateral surface of the circuit section 1, which is used by attaching the upper end portion of the control circuit section 1 to a ceiling surface and so forth.

In a substantially rectangular case 1*a* the control circuit section 1 has an electric power source circuit and a control circuit which are not shown here, and by controlling electric power input from the ceiling surface and so forth, the control circuit 1 supplies the controlled electric power to a plurality of multi-color light emitting diodes 13*a*, 13*b*, 13*c*, and 13*d*, which are described below.

The body 2 is comprised of a rear cylindrical portion 10 connected with the lateral surface of the control circuit section 1 rotatably around the horizontal axis thereof, and a front cylindrical portion 20 connected with the front side of the rear cylindrical portion 10.

The rear cylindrical portion 10 is provided with a body section 11, a LED substrate 13 provided as a light source in the body section 11, a heat sink 12 for dissipating the heat from a plurality of multi-color light emitting diodes, which is disposed on the rear side of the LED substrate 13, and a lens unit 14 for refracting the light emitted by said plurality of multi-color light emitting diodes and radiating the refracted light in the front direction.

The body section 11 is a cylindrical member made of a metal material and has a groove 11*a* for connecting the below-mentioned front cylindrical portion 20 on the inner peripheral surface on the front edge side thereof. Although the groove 11*a* is provided throughout the entire circumference on the inner peripheral surface of the body section 11 as illustrated in the drawing, the groove 11*a* may be provided only on the lower end side.

Further, a cutout portion 11*b* is formed at the upper portion on the front end side of the body section 11 so as to fit from the rear side to a connection screw 26 threadably mounted on the front cylindrical portion 20.

Further, the heat sink 12 is connected and fixed to the rear end at the opening section of the body section 11.

The heat sink 12 is formed with folded fins so as to efficiently dissipate the heat generated by the multi-color light emitting diodes.

Further, the LED substrate 13 is provided on the rear end side in the body section 11 so as to have contact with the front end surface of the heat sink 12.

Figure 4:
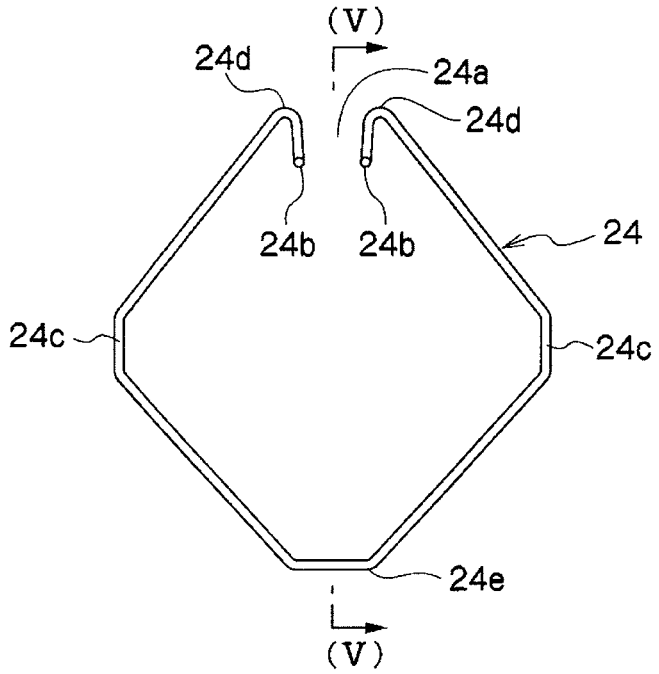
FIG. 4 is a front view illustrating an example of a frame shaped spring member.

The LED substrate 13 is a flat disk shaped printed substrate, and has a plurality of (four as illustrated in FIG. 4) multi-color light emitting diodes, 13*a*, 13*b*, 13*c* and 13*d* attached on the surface thereof.

Each of the multi-color light emitting diodes 13*a* (13*b*, 13*c*, or 13*d*) has a plurality of LED chips, r, g, b, and w with different light emission colors (as an example, four colors of red, green, blue and white as illustrated in the drawing) disposed on the same circumference at regular intervals on the front surface of a rectangular base section p (see FIG. 13), and a substantially hemispherical lens section q is provided on the front side of the LED chips, which refract the light emitted by the LED chips and emits the light in the front direction and electric power source is configured to supply power to each of the LED chips.

As such, according to the multi-color light emitting diodes 13*a* (13*b*, 13*c*, or 13*d*), when concurrently lighting the plurality of the LED chips having a plurality of light emission colors, various different colors which are combinations of the light emitted by the plurality of LED chips can be created by appropriately adjusting the output of each LED chip. Further, when white light is emitted, the color temperature can be changed or a delicate color tone can be added thereto.

According to an example of this embodiment, although the multi-color light emitting diodes 13*a* (13*b*, 13*c*, or 13*d*) employ "CREE INC. USA X lamp (registered trademark) MC-E LED Color Neutral White LED View angle 110 degree", multi-color light emitting diodes or full-color light emitting diodes made by other manufacturers may be employed as long as the same structure is available.

Further, each of the plurality of the multi-color light emitting diodes (for example 13*b*) is disposed while being rotated by a prescribed angle with reference to one other multi-color light emitting diode (for example 13*a*) in such a manner that when translating the light emitting diode 13*b* so as to overlap with the multi-color light emitting diode 13*a*, LED chips having the same light emission color do not overlap with each other. Here, the above-mentioned "rotated" means that each of the multi-color light emitting diodes is rotated around the center axis of each multi-color light emitting diode.

Figure 13:
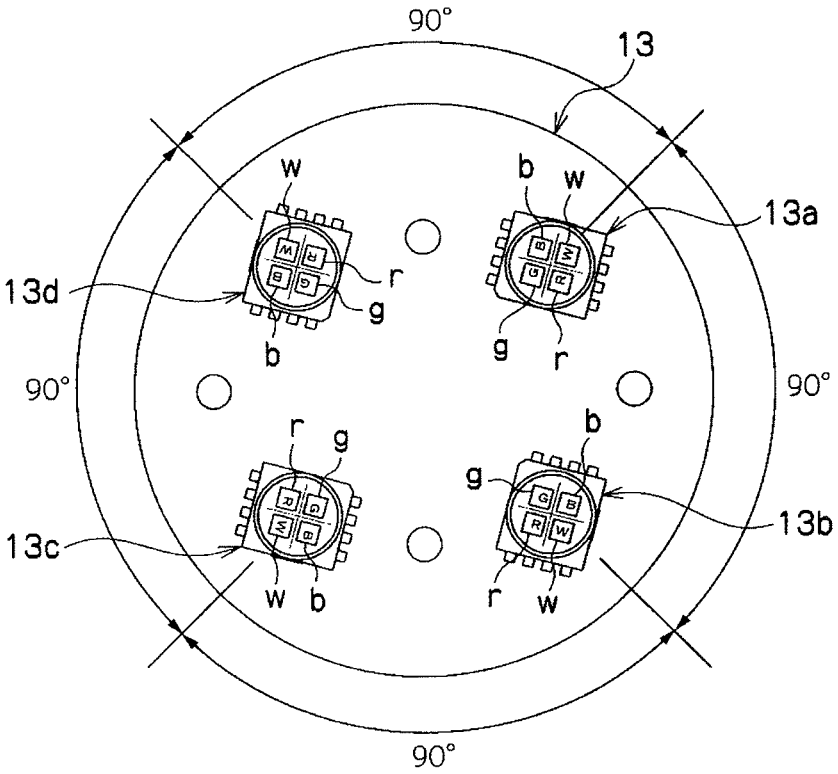
FIG. 13 is a plan view illustrating an example of a substrate to which four multi-color light emitting diodes are attached.

In particular, in a preferred example shown in FIG. 13, each multi-color light emitting diode is configured such that when overlapping each multi-color light emitting diode with one other multi-color light emitting diode, LED chips having mutually different light emission colors overlap with each other.

More specifically, according to an example shown in the drawing, n of said plurality of multi-color light emitting diodes are disposed on the same circumference at regular intervals, and each multi-color light emitting diode is disposed while being rotated by 360/n degrees with respect to the circumferentially adjoining multi-color light emitting diodes.

That is, according to an example shown in FIG. 13, four multi-color light emitting diodes 13*a*, 13*b*, 13*c* and 13*d* are provided on the same circumference at regular intervals, and each multi-color light emitting diode (for example, 13*b*) is disposed while being rotated clockwise by 90 degrees with respect to adjoining multi-color light emitting diodes (13*a*).

Further, on the front side of the LED substrate 13, a lens unit 14 and a second lens 23 which is described below are provided in order to mix the light emitted by said plurality of multi-color light emitting diodes.

The lens unit 14 is configured to concentrates the light emitted by the plurality of multi-color light emitting diodes 13*a*, 13*b*, 13*c* and 13*d* for each of the multi-color light emitting diodes and diffuses the light.

More specifically, the lens unit 14 has the first lens 14*a* disposed in the proximity of or in contact with the front side of each of said plurality of multi-color light emitting diodes.

Figure 6:
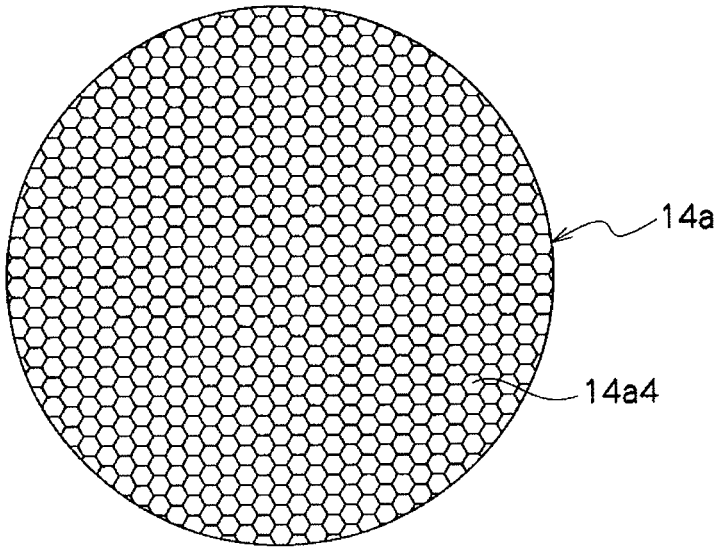
FIG. 6 is a plan view illustrating the front side of a first lens.
Figure 7:
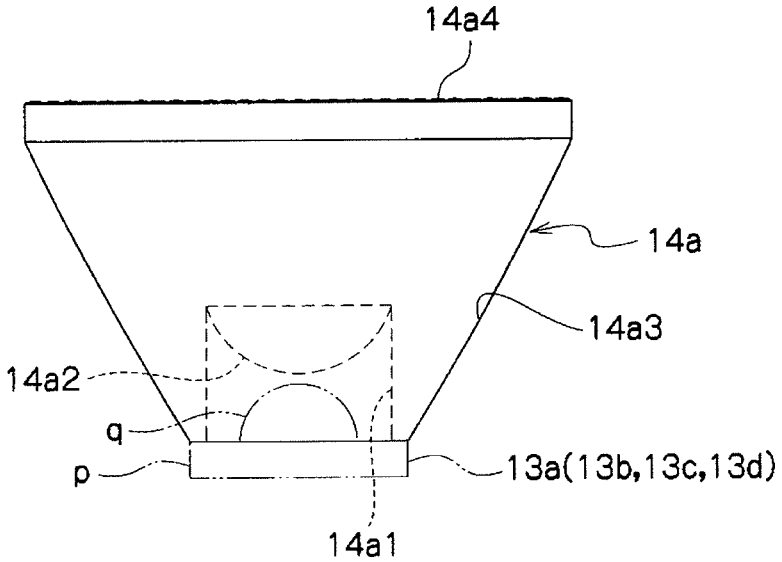
FIG. 7 is a side view of a first lens.
Figure 8:
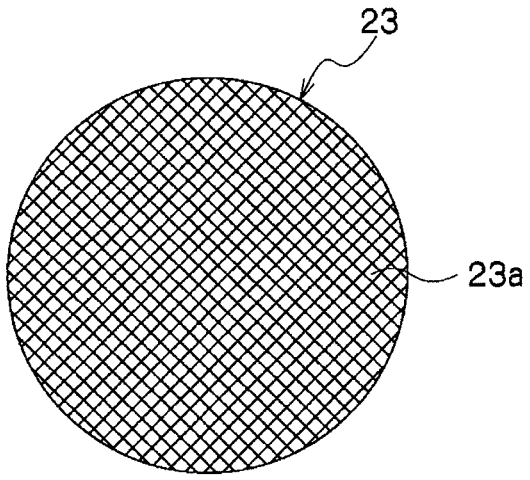
FIG. 8 is a plan view illustrating the front side of a second lens.

Each of the first lens 14*a* has substantially a reverse cone shape having the diameter gradually increasing in the front direction as shown in FIGS. 6 and 7, which has a column-shaped recessed portion 14*a*1 at the rear end portion while having a substantially spherical convex portion 14*a*2 projecting in the rear side direction at the bottom portion (upper portion in the drawing) in the recessed portion 14*a*1.

A lens section q of the multi-color light emitting diode 13*a* (13*b*, 13*c*, or 13*d*) is inserted into the recessed portion 14*a*1 and the convex portion 14*a*2 is in the proximity of or in contact with the lens section q of the multi-color light emitting diode 13*a* (13*b*, 13*c*, or 13*d*).

A number of fine uneven profiles 14*a*4 for radiating diffused light are formed on the front surface of the first lens 14*a*.

According to the first lens 14*a*, the light incident onto the inner peripheral wall of the recessed portion 14*a*1 from among the light emitted into the recessed portion 14*a*1 by the multi-color light emitting diode 13*a* (13*b*, 13*c*, or 13*d*) is refracted by the inner peripheral wall and is subject to total internal reflection on the inner surface 14*a*3 of the inclined outer periphery to travel substantially in the forward direction so that the uneven profiles 14*a*4 on the front surface emits diffuse light.

Further, the light incident onto the convex portion 14*a*2 is refracted by the surface of the convex portion 14*a*2 to travel substantially in the forward direction so that the uneven profiles 14*a*4 on the front surface emits diffuse light.

The above-mentioned first lens 14*a* may be substituted by a lens not shown here or a combination of multiple lenses as long as the same effect is produced.

Figure 2:
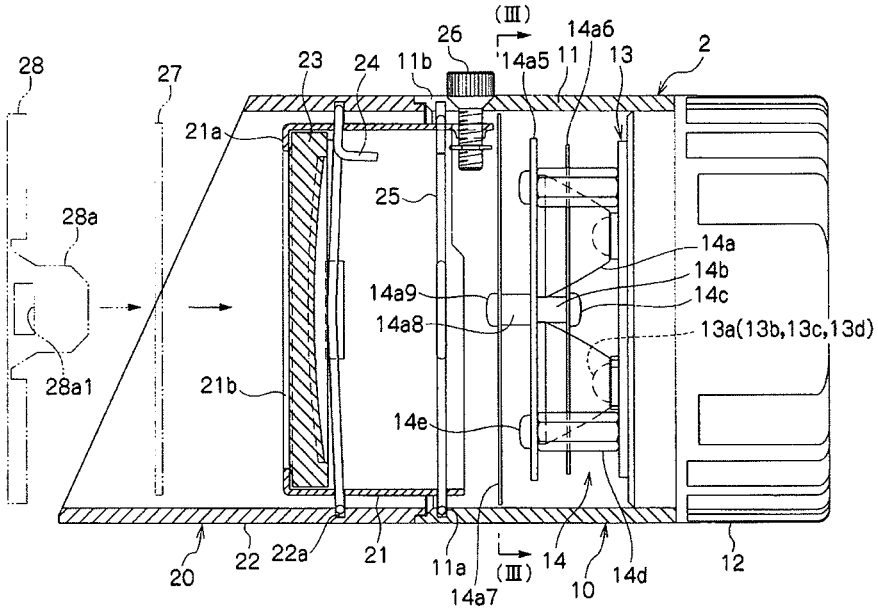
FIG. 2 is a vertical cross-sectional view illustrating a body of an illumination device.

The plurality of first lenses 14*a* are disposed on the same circumference at regular intervals so as to correspond to each of the multi-color light emitting diodes 13*a* 13*b*, 13*c* and 13*d*, and integrally held in place by being sandwiched between a front side support bracket 14*a*5 and a rear side support bracket 14*a*6 (see FIG. 2).

Figure 3:
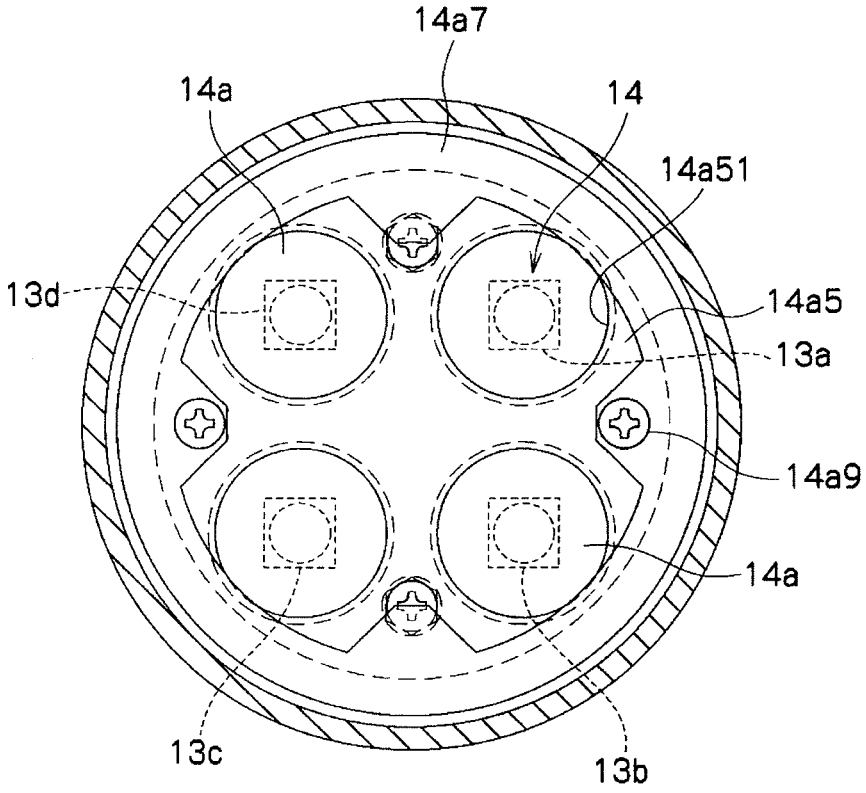
FIG. 3 is a cross-sectional view taken along the line (III)-(III) in FIG. 2.

The front side support bracket 14*a*5 is made of a metal circular plate having a plurality of through-holes 14*a*51 through which the light emitted from each of the first lenses passes through (see FIG. 3).

The rear side support bracket 14*a*6 is made of a metal circular plate having a plurality of through-holes which come into contact with the outer peripheral surface of each reverse cone shaped first lens 14*a*.

Further, these front side and rear side support brackets 14*a*5, 14*a*6 are coupled by a column-shaped coupling member 14*b* and a screw 14*c* while sandwiching the plurality of first lenses 14*a* from the front and rear sides.

Further, the support bracket 14*a*5 is coupled to the heat sink 12 such that the support bracket 14*a*5 and the heat sink 12 sandwich a column-shaped coupling member 14*d* and the LED substrate 13. More specifically, the support bracket 14*a*5 is fixed in place by a screw 14*e* at the one end side of the coupling member 14*d* (left end side in FIG. 2). Further, a screw section (not shown) is provided on the other end side of the coupling member 14*d* (right end side in FIG. 2) and the screw section passes through the LED substrate 13 to be screwed within the heat sink 12.

Further, a light shield plate 14*a*7 is provided on the front side of the lens unit 14, which is located between the front surface of the first lens 14*a* and the joint between the front and rear cylindrical portions 10, 20 (see FIGS. 2 and 3).

The light shield plate 14*a*7 is an annular circular plate substantially surrounding the plurality of first lenses 14*a* with the outer periphery thereof being in the proximity of the inner peripheral surface of the rear cylindrical portion 10 and is coupled to the support bracket 14*a*5 by a column-shaped coupling member 14*a*8 and a screw 14*a*9.

The light shield plate 14*a*7 can prevent the light emitted by the lens unit 14 from leaking out from a gap between the front cylindrical portion 20 and the rear cylindrical portion 10.

Further, the front cylindrical portion 20 is provided with a combining cylindrical portion 21 detachably connected with the main body section 11 of the rear cylindrical portion 10, a hood 22 covering the periphery of the combining cylindrical portion 21 rotatably around the optical axis (the center line of the second lens 23), a second lens 23 provided on the front end side of the combining cylindrical portion 21 rotatably around the optical axis, a front side frame shaped spring member 24 provided on the rear side of the second lens 23 in the combining cylindrical portion 21, and a rear side frame shaped spring member 25 provided on the rear end side in the combining cylindrical portion 21.

The combining cylindrical portion 21 is formed to have a polygonal tubular shape so as to have a slight gap formed between the outer surface thereof and the inner peripheral surface of the cylindrical hood 22. The front end portion of the combining cylindrical portion 21 having a polygonal bottom portion is provided with a circular hole 21*b* through which the light emitted from the second lens 23 passes and an edge portion 21*a* of the hole 21*b*, and the edge portion 21*a* has contact with the front side of the second lens 23.

The hood 22 has substantially a cylindrical shape with the front end portion being obliquely cutoff and has an annular groove 22*a* formed on the inner peripheral surface thereof continuously throughout the circumference, which fits to a below-mentioned front side frame shaped spring member 24.

The rear edge portion of the hood 22 has a step-like diameter reduced portion which fits with some room to move (gap) rotatably to a step-like diameter expanded portion formed on the inner peripheral surface of the rear cylindrical portion 10 at the front edge portion thereof.

The whole shape of the second lens 23 is substantially a disk-like shape and has an unevenly profiled portion 23*a* and an unevenly profiled portion 23*b* respectively on the front surface and the rear surface thereof.

Figure 9:
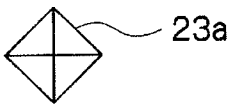
FIG. 9 is a main part enlarged view of FIG. 8.

Specifically, the front surface of the second lens 23 is formed entirely as a substantially flat shape and has the unevenly profiled portion 23*a* formed with a number of fine quadrangular pyramid-shaped recessed portions (see FIG. 9) on the flat surface.

Further, the rear surface of the second lens 23 is dented entirely like a concave lens and has a plurality of rows of corrugated sheet-like unevenly profiled portion 23*b* on the dented surface. Each recessed portion forming the unevenly profiled portion 23*b* has a concave shaped cross-section continuing in one direction. Further, a number of fine uneven profiles (not shown) are provided on the surface of the unevenly profiled portion 23*b*.

Figure 10:
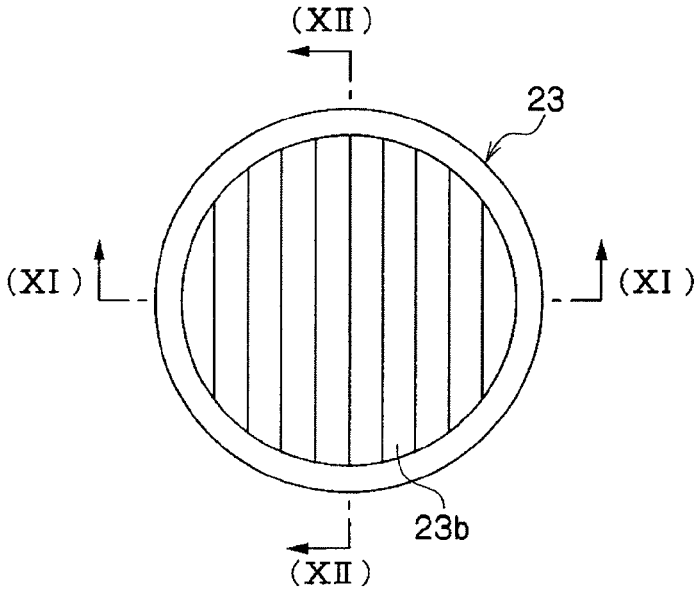
FIG. 10 is a plan view illustrating the rear side of a second lens.
Figure 11:
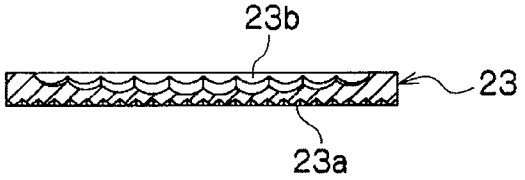
FIG. 11 is a cross-sectional view taken along the line (XI)-(XI) in FIG. 10.
Figure 12:
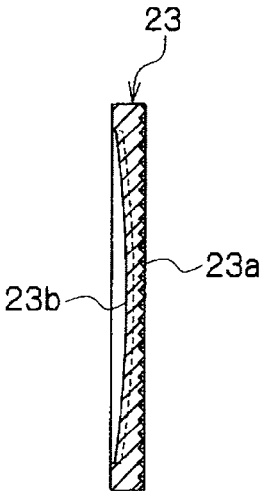
FIG. 12 is a cross-sectional view taken along the line (XII)-(XII) in FIG. 10.

According to the second lens 23, the light incident from the rear surface side (the upper surface side in FIG. 11) will diffuse by passing through the front and rear unevenly profiled portions 23*b* and 23*a* and the diffused light is emitted from the front surface. At that time, a degree of light diffusion is larger in the direction (horizontal direction in FIG. 10) orthogonal to the direction in which the unevenly profiled portion 23*b* continues on the rear surface (vertical direction in FIG. 10) than in the direction in which the unevenly profiled portion 23*b* continues.

The second lens 23 may be substituted by a lens not shown here as long as the same effect is produced.

The second lens 23 as configured above is attached to the front end side in the combining cylindrical portion 21 with some gap between the periphery of the second lens 23 and the inner peripheral surface of the combining cylindrical portion 21, which allows the second lens 23 to rotate around the optical axis in the combining cylindrical portion 21. Further, the second lens 23 is elastically pressed from the rear side by the front side frame shaped spring member 24 while having contact with an inward edge portion 21*a* on the front end of the combining cylindrical portion 21 (see FIG. 2).

The front side frame shaped spring member 24 has one part of the outer periphery (the upper end side portion in an example shown in FIG. 2) and one other part thereof opposing the one part (the lower end side portion in the example shown in FIG. 2), each of which passes through the combining cylindrical portion 21 and fits into the annular groove 22*a* on the inner peripheral surface of the hood 22 with some room to move (gap), whereby the front side frame shaped spring member 24 is latched with the combining cylindrical portion 21 to elastically press the second lens 23 from the rear side while holding the hood 22 rotatably and unmovably in the back-and-forth direction with the one part and the one other part.

Figure 5:
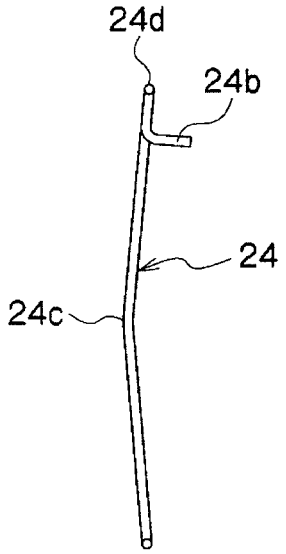
FIG. 5 is a cross-sectional view taken along the line (V)-(V) in FIG. 4.

More specifically, the front side frame shaped spring member 24 is formed by bending a metal spring wire rod as a rectangular shaped frame having a cut 24*a* as shown in FIGS. 4 to 5. Knobs 24*b*, 24*b* are formed at the end of the cut 24*a* which are bent backward. Further, the front side frame shaped spring member 24 is bent to form a < shape when viewed from the lateral side with the cut 24*a* directed upward (see FIG. 5) and has projection portions 24*c*, 24*c* directed forward.

The front side frame shaped spring member 24 as configured above has its diameter reduced by both side knobs 24*b*, 24*b* being pinched and is inserted into the combining cylindrical portion 21. Further, upper end side portions 24*d*, 24*d* and a lower end side portion 24*e* of the front side frame shaped spring member 24 are inserted through-holes provided in the combining cylindrical portion 21 respectively so as to fit into the annular groove 22*a* of the hood 22 with some room to move (gap). And thus, the hood 22 is held rotatably around the optical axis and unmovably in the back-and-forth direction with respect to the combing cylindrical portion 21 and the front side frame shaped spring member 24.

Further, both projection portions 24*c*, 24*c* of the front side frame shaped spring member 24 fit into through-holes provided in the combining cylindrical portion 21 respectively. Under the state of engagement, the front side frame shaped spring member 24 allows the portion on the side of the projection portion 24*c* to come into contact with the second lens 23, thereby elastically press the second lens 23 (see FIG. 2). As such, the second lens 23 is held with little rattle and is rotatable as necessary.

Further, the rear side frame shaped spring member 25 (see FIG. 2) is formed as a rectangular shaped frame that is made of a metal spring wire rod with a cut at the top, which is substantially the same as the above-mentioned front side frame shaped spring member 24. The rear side frame shaped spring member 25 allows the corner side portion of the lower end side opposing the cut to pass through the combing cylindrical portion 21 so as to fit into a groove 11*a* on the inner peripheral surface of the rear cylindrical portion 10 while another corner side portion is latched with the combing cylindrical portion 21.

Further, the connection screw 26 is threadably mounted on the upper end portion more backward than the rear side frame shaped spring member 25 in the combing cylindrical portion 21. Further, the neck portion of the connection screw 26 is inserted through a cutout portion 11*b* at the upper part of the front end side of the rear cylindrical portion 10 and is tightened there.

Therefore, if the connection screw 26 is loosened and removed from the cutout portion 11*b* and the lower end portion of the rear side frame shaped spring member 25 is removed from the groove 11*a* on the lower end portion of the rear cylindrical portion 10, the front cylindrical portion 20 can be easily removed from the rear cylindrical portion 10.

Reversely, when assembling the device, if the lower end portion of the rear side frame shaped spring member 25 is fitted into the groove 11*a* on the lower end of the rear cylindrical portion 10 and the connection screw 26 is fitted into the cutout portion 11*b* and is tightened there, the front cylindrical portion 20 can be easily connected to the rear cylindrical portion 10.

Further, in FIG. 2, a symbol 27 shows a disk shaped filter and a symbol 28 is a cover for supporting the filter 27. The cover 28 is formed as a frame shaped cover to cover the filter 27 and has engagement pieces 28*a* backwardly projected respectively at both ends. Each of the engagement pieces 28*a* has an engagement hole 28*a*1 for engaging with a projection portion provided on the outer periphery of the combing cylindrical portion 21 not shown here.

When attaching the cover 28 to the front cylindrical portion 20, each of the engagement pieces 28*a* may be inserted in a gap secured between the inner peripheral surface of the hood 22 and the outer peripheral surface of the combing cylindrical portion 21 and the engagement holes 28*a*1 may be fitted around the projection portions (not shown) on the peripheral surface of the combing cylindrical portion 21.

Further, when the cover 28 is removed from the front cylindrical portion 20, both engagement pieces 28*a*, 28*a* may be elastically bent in the diameter expansion direction and the engagement holes 28*a*1 may be disengaged from the projection portions.

Hereinafter, the characteristic effect of the illumination device A according to the embodiment 1 will be described in detail by contrast with a comparative example.

Figure 15:
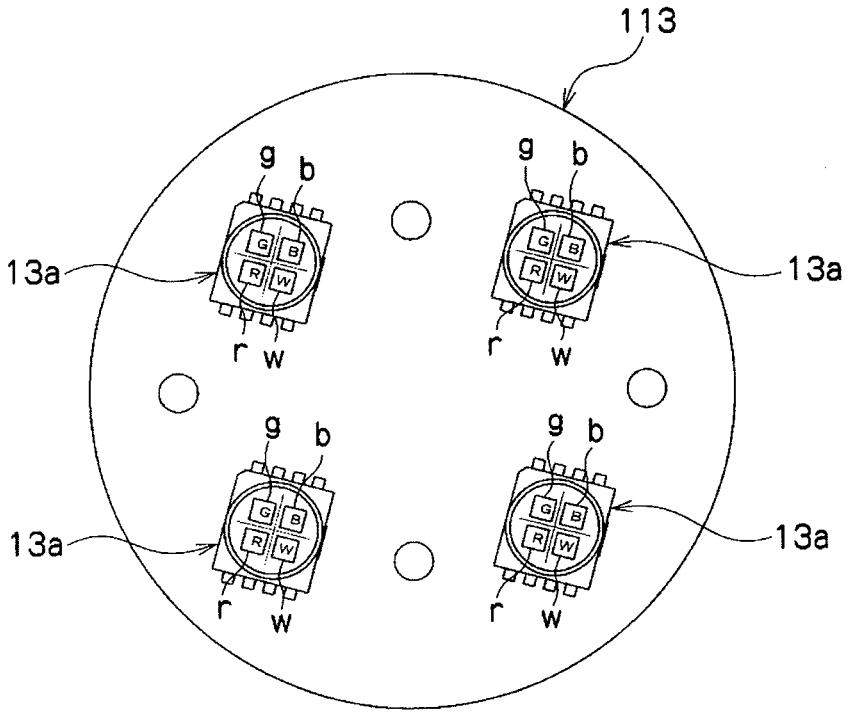
FIG. 15 is a plan view illustrating a comparative example of a substrate to which four multi-color light emitting diodes are attached.

In the comparative example, the LED substrate 13 in the illumination device A as configured above is substituted by an LED substrate 113 (see FIG. 15).

The LED substrate 113 as shown in the comparative example has each of a plurality of multi-color light emitting diodes 13*a* disposed entirely at the same angle in such a manner that when each of the plurality of multi-color light emitting diodes 13*a* overlaps with one other multi-color light emitting diode 13*a*, LED chips having the same light emission color overlap with each other.

According to the illumination device A of the embodiment 1, the light emitted by the plurality of multi-color light emitting diodes 13*a*, 13*b*, 13*c*, and 13*d* is concentrated by the plurality of first lenses 14*a* in the lens unit 14 and is diffused thereafter, and further is diffused by the second lens 23 so that mixed light is emitted therefrom. The emitted light has different degrees of light diffusion between the vertical and horizontal directions due to action of the corrugated sheet-like unevenly profiled portion 23*b* on the second lens 23 and is irradiated onto an object to be irradiated such as a wall and so forth.

Figure 16:
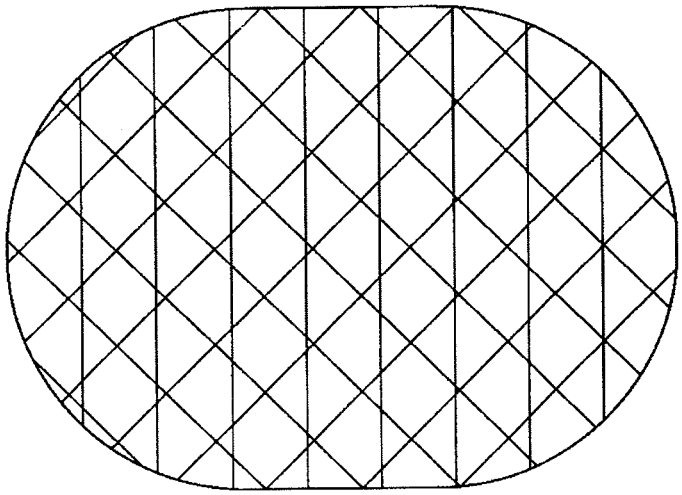
FIG. 16 is a schematic view illustrating the light irradiated onto a wall surface by an illumination device according to the present invention.

The irradiated light has little color inconsistency with no separation of the plurality of mixed light emission colors (red, green, blue and white) (see FIG. 16).

That is, the illumination device A according to this embodiment has each multi-color light emitting diode disposed while being rotated with respect to one other multi-color light emitting diode in such a manner that LED chips having the same light emission color do not overlap with each other, and thus a plurality of different light emission colors are overlapped and favorably mixed with each other so that the irradiation light having little color inconsistency can be acquired.

Figure 17:
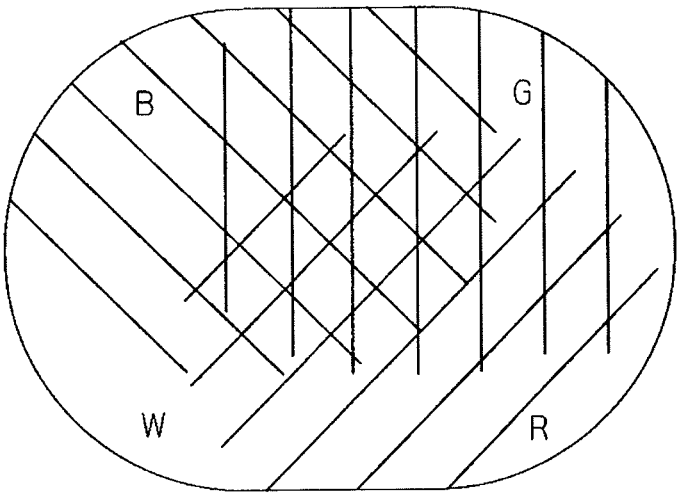
FIG. 17 is a schematic view illustrating the light irradiated onto a wall surface by an illumination device of a comparative example.

In contrast, the illumination device of the comparative example resulted in significant color inconsistency in the irradiation light due to the separation of a plurality of light emission colors (red, green, blue and white) (see FIG. 17).

That is, the illumination device of the comparative example has each multi-color light emitting diode disposed with respect to one other multi-color light emitting diode in such a manner that LED chips having the same light emission color are overlapped with each other, whereby the light emitted by the LED chips having the same light emission color is intensified in response to the mutual overlap, and thus resulting in the irradiation light with significant color inconsistency. More specifically, although a plurality of spreading light emission colors are overlapped with each other thereby generating relatively decreased color inconsistency in the proximity of the center of the irradiation light, the closer to the periphery, the more significant color inconsistency appears with less overlapping of light emission colors.

Also, it should be understood that FIG. 16 and FIG. 17 are schematic views to illustrate easily to understand the difference in effect between the illumination device A of the embodiment 1 and the comparative example and do not show actual irradiation light.

Further, according to the illumination device A of the embodiment 1, the direction in which a degree of light diffusion is increased can be changed by rotating the second lens 23. For example, when irradiating a horizontally long picture, the continuous direction of unevenly profiled portion 23*b* in the second lens 23 may be directed in a vertical direction such that the degree of light diffusion in a horizontal direction as shown in FIG. 16 is increased.

Further, for example, when irradiating a vertically long picture, the continuous direction of unevenly profiled portion 23*b* in the second lens 23 may be directed in a horizontal direction by rotating the second lens 23 such that the degree of light diffusion in a vertical direction is increased.

Further, according to the illumination device A of the embodiment 1, light can be emitted only in a necessary direction using a hood 22 having a obliquely cut shape, and the emission direction can be changed by rotating the hood 22.

For example, in order to irradiate the wall surface with the emitted light while not irradiating the floor side, the optical axis may be directed to the wall surface with the projecting portion of the hood 22 being directed downward by applying a rotational adjustment to the hood 22.

Figure 14:
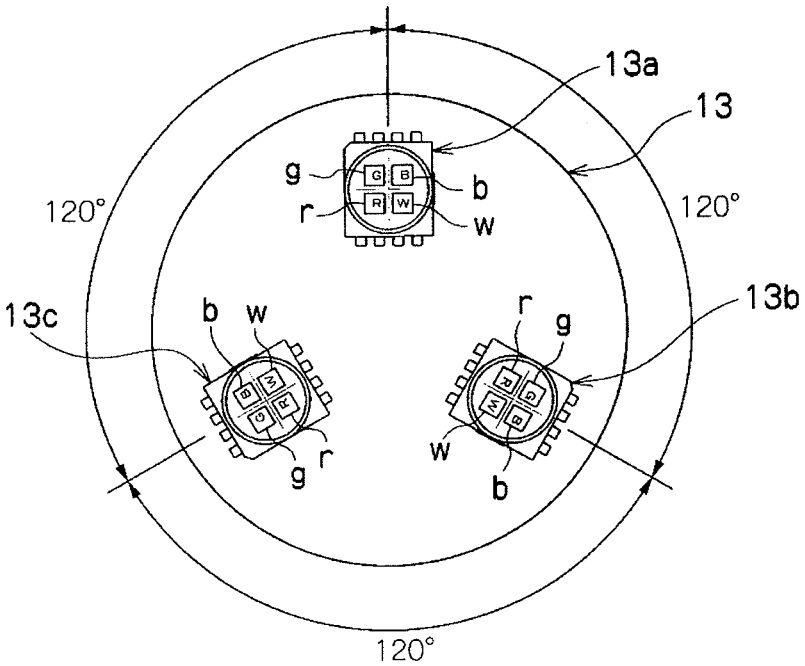
FIG. 14 is a plan view illustrating an example of a substrate to which three multi-color light emitting diodes are attached.

Also, although four multi-color light emitting diodes are provided in the above embodiment 1, three multi-color light emitting diodes may be provided in another example (see FIG. 14), alternatively a configuration having two or no less than 5 multi-color light emitting diodes may be also available.

Further in the above embodiment 1, as a particularly preferable configuration, each of a plurality of multi-color light emitting diodes is disposed while being rotated with respect to one other multi-color light emitting diode by a prescribed angle with reference to said one other multi-color light emitting diode in such a manner that when each of the plurality of multi-color light emitting diodes overlaps with said one other multi-color light emitting diode, LED chips emitting the same light emission color do not overlap with each other. However, the effect of a decrease in color inconsistency can be achieved by setting to the above positional relationship at least one multi-color light emitting diode from among the plurality of multi-color light emitting diodes.

Further, in the above embodiment 1, although four LED chips having different light emission colors of r, g, b, and w are provided for each multi-color light emitting diode, two, three, or no less than five LED chips having different light emission colors may be provided for each multi-color light emitting diode in another example. Still further, in another example, a plurality of types of multi-color light emitting diodes having different number of LED chips may be employed.

Further, in the above embodiment 1, although light is diffused in two steps by the lens unit 14 and the second lens 23 as a particularly preferable configuration, a configuration using a single lens or three or more lenses, a configuration using a reflection board, a configuration using both a lens and a reflection board, and so forth may be adopted as long as the same mixture effect can be produced.

Further, in the above embodiment 1, although the wall washer-type illumination device A is configured, a spotlight can be also configured as another preferable example.

Next, an illumination device B representing spotlight type illumination device is described in detail as an embodiment 2.

In the illumination device B as illustrated below, with respect to substantially the same parts as the above illumination device A, the same symbols as the illumination device A are applied in order to avoid duplicated descriptions.

Embodiment 2

Figure 18:
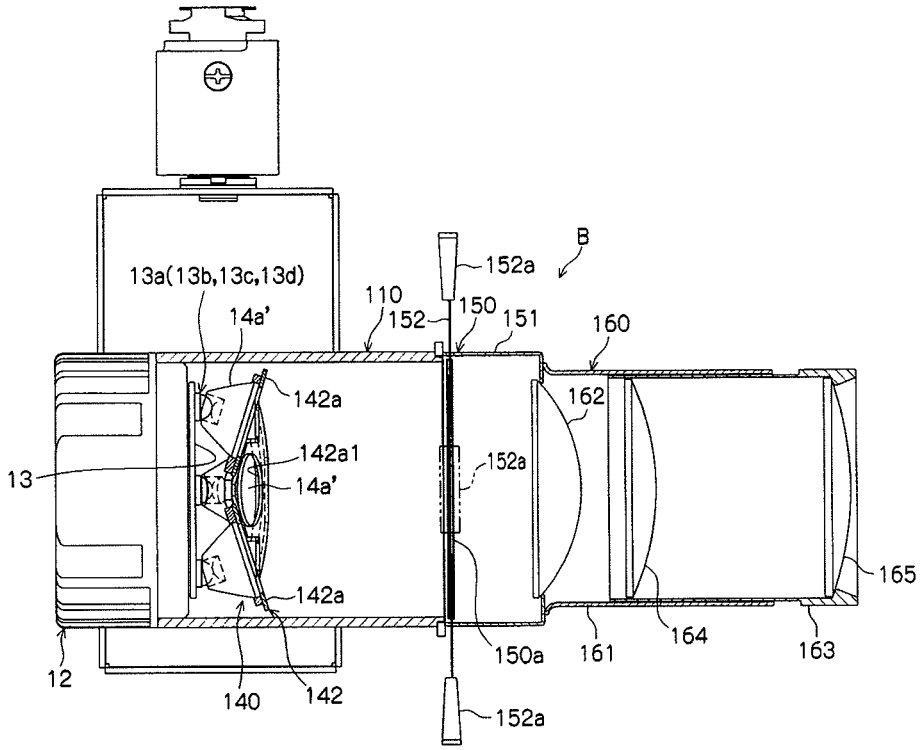
FIG. 18 is a vertical cross-sectional view illustrating an embodiment 2 of an illumination device according to the present invention.
Figure 19:
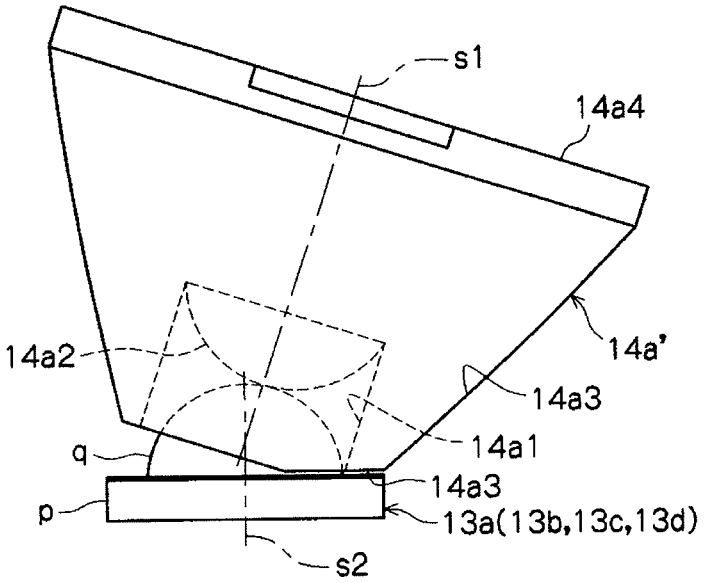
FIG. 19 is a side view illustrating a first lens of an embodiment 2 of an illumination device.

The illumination device B is a spotlight comprising: a cylindrical body 110, a heat sink 12 fixed to the rear end side of the body 110, an LED substrate 13 provided as a light source on the rear end side in the body 10, a lens unit 140 for concentrating the light emitted by multi-color light emitting diodes 13*a*, 13*b*, 13*c* and 13*d* on the LED substrate 13, an aperture 150 for allowing the light emitted from the lens unit 140 to pass therethrough, and a second lens 160 for emitting in the forward direction the light passing through the aperture 150 (see FIGS. 18 to 19).

The body 110 is a cylindrical metal member with the front and rear end portions being opened.

The heat sink 12 is connected with and fixed to the rear end opening of the body 110. The front end surface of the heat sink 12 is formed as substantially a flat shape and the LED substrate 13 is attached thereto.

Further, the lens unit 140 is provided on the front side of the LED substrate 13 in order to concentrate the light emitted by the plurality of multi-color light emitting diodes 13*a*, 13*b*, 13*c* and 13*d* toward the center of the aperture 150.

The lens unit 140 includes a plurality of first lenses 14*a*' (four is shown in the example) respectively corresponding to said plurality of multi-color light emitting diodes so as to concentrate the light emitted by said plurality of multi-color light emitting diodes for each multi-color light emitting diode.

Figure 20:
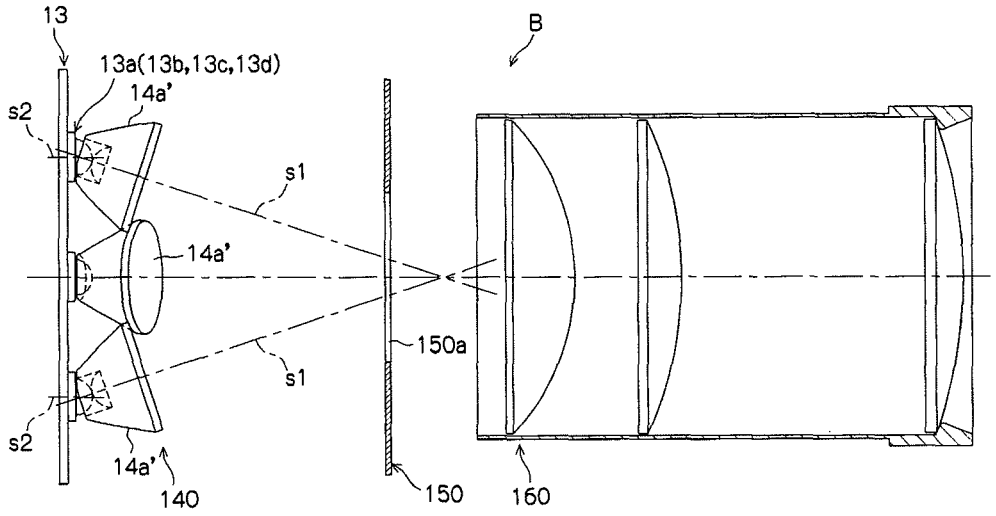
FIG. 20 is a schematic view of an embodiment 2 of an illumination device.

Each of the plurality of first lenses 14*a*' is disposed with its optical axis s1 being inclined with respect to the center axis s2 of the multi-color light emitting diode such that the emitted light therefrom is directed to the opening 150*a* in the center side of the aperture 150 (in other words the center axis side of the body 110) (see FIG. 19 and FIG. 20).

More specifically, the inclination of each first lens 14*a*' is set in such a manner that the cross-section of light flux emitted from each first lens 14*a*' is slightly larger than the maximally opened opening 150*a* in the aperture 150.

Further, the optical axes s1 of the plurality of first lenses 14*a*' are concentrated on one point on the center axis line of the body 110 between the aperture 150 and the second lens 160 according to the example shown in the drawing (see FIG. 20).

Each first lens 14*a*' has a flat part 14*a*3 which is substantially parallel to the front surface of the LED substrate 13 on the outer surface on the rear edge side of the recessed portion 14*a*1.

The flat part 14*a*3 comes into contact with the base section p of the multi-color light emitting diode 13*a* (13*b*, 13*c* or 13*d*) substantially parallel thereto.

According to the flat part 14*a*3, the lens section q for the multi-color light emitting diode 13*a* (13*b*, 13*c* or 13*d*) can be deeply inserted into the recessed portion 14*a*1 of the first lens 14*a*' in such a manner that the outer surface of the lens section q is in the proximity of or in contact with the outer surface of the convex portion 14*a*2 in the recessed portion 14*a*1, and thus it is possible to minimize the leak of the light emitted by the multi-color light emitting diode 13*a* (13*b*, 13*c* or 13*d*) from a gap between the rear end portion of the first lens 14*a*' and the base section p of the multi-color light emitting diode 13*a* (13*b*, 13*c* or 13*d*). Further, the flat part 14*a*3 of the first lens 14*a*' is arranged to come into contact with the flat base section p, whereby the first lens 14*a*' can be stably fixed.

As such, the plurality of first lenses 14*a*' is supported by a single support bracket 142 and the support bracket 142 is fixed to the LED substrate 13.

The support bracket 142 is formed substantially as a round shape so as to cover the plurality of first lenses 14*a*' from front and has a plurality of inclined surfaces 142*a* with which the front end surface of each first lens 14*a*' comes into contact while each inclined surface 142*a* has a round shaped opening 142*a*1 facing the emission surface (front end surface) of the first lens 14*a*'.

The support bracket 142 integrally fixes the plurality of first lenses 14*a*' and is supported by the LED substrate 13 via a fixing member such as a screw, a bolt. etc. and a spacer (not shown).

The light emitted from the lens unit 140 as configured above passes through the aperture 50.

The aperture 150 includes a rectangular tube shaped tubular body portion 151 and four dividers 152 that are inserted into the left, right, top and bottom of wall portion of the tubular body portion 151 movably in the vertical and horizontal directions in such a way that a rectangular hole shaped opening 150*a* surrounded by the four dividers 152 is formed in the center side of the tubular body portion 151 (see FIG. 18).

According to the aperture 150, by moving each divider 152 in the insertion and pull-out directions by holding a lever 152*a* provided on the end of each divider, the size of the opening 150*a* can be changed in the vertical direction and the horizontal direction, and thus the size of the rectangular shape light irradiated by the illumination device B onto an object to be irradiated can be changed in the vertical and horizontal directions.

Further, a second lens 160 having a known structure is provided on the front side of the aperture 150, which emits in the forward direction rectangular-shape light flux passing through the aperture 150.

The second lens 160 is provided with a cylindrical fixed tube 161 fixed to the front end of the tubular body portion 151 of the aperture 150, a single fixed lens 162 fixed in the fixed tube 161, a slide tube 163 provided slidably forward and backward on the front side of the fixed tube 161, and two movable lenses 164, 165 fixed in the slide tube 163. The second lens 160 is configured such that focus adjustment is performed by moving forward and backward the slide tube 163 and the two movable lenses 164, 165.

According to the illumination device B as configured above, only the first lens 14*a*' is inclined in such a way that the light emitted from the first lens 14*a*' is directed toward the center of the aperture 150 without inclining the multi-color light emitting diodes 13*a*, 13*b*, 13*c* and 13*d*, and thus an inclined section does not need to be formed on the LED substrate 13 and the heat sink 12. As such, the light emitted by the plurality of multi-color light emitting diodes can be efficiently concentrated and favorable productivity is achieved.

Also, in the illumination device B, a spotlight is configured by inclining the optical axes s1 of the plurality of first lenses 14*a*' toward the center side of the plurality of first lenses 14*a*'. In another example, the optical axes of a part or a whole of the plurality of first lenses may be inclined in a direction away from the center of the plurality of first lenses such that a light for diffusing the emission light or a signal lamp visible from multiple angles can be configured.

DESCRIPTION OF SYMBOLS

A, B: illumination device
r, g, b, w: LED chip
s1: optical axis
s2: center axis
2, 110: lighting body
10: rear cylindrical portion
12: heat sink
13: LED substrate
13*a*, 13*b*, 13*c*, 13*d*: multi-color light emitting diode
14: lens unit
14*a*, 14*a*': first lens
14*a*1: recessed portion

14a2: convex portion
14a3: flat part
14a5, 14a6, 142: support bracket
20: front cylindrical portion
21: combining cylindrical portion
22: hood
22a: annular groove
23, 160: second lens
24: front side frame shaped spring member
25: rear side frame shaped spring member
150: aperture

The invention claimed is:

1. An illumination device for mixing and radiating the light emitted by a plurality of multi-color light emitting diodes, the illumination device comprising:

a plurality of first lenses disposed in correspondence to each of said plurality of multi-color light emitting diodes in contact with or in the proximity of a front side thereof;

a second lens disposed on a front side of the plurality of first lenses, said second lens has a concave rear surface and a corrugated sheet-like unevenly profiled portion provided by a plurality of rows of recessed portions with concave shaped cross-sections on the concave rear surface, a hood covering the front side of said second lens, said hood has a shape with a front end portion extending obliquely and is arranged rotatably around an optical axis of said second lens;

a rear cylindrical portion having said plurality of multi-color light emitting diodes, the rear cylindrical portion being connected to said first lens with a front cylindrical portion having said second lens and said hood;

said front cylindrical portion includes a combining cylindrical portion detachably connected to said rear cylindrical portion, said hood extended over the periphery of the combining cylindrical portion, said second lens rotatably provided on the front end side in said combining cylindrical portion, and a rectangular shaped spring member provided on the rear side of the second lens in said combining cylindrical portion;

an inward edge portion extending inwardly to contact the second lens from the front side is provided at the front edge of said combining cylindrical portion; and an annular groove continuing throughout the circumference of the hood is provided on an inner peripheral surface of said hood, wherein said rectangular shaped spring member defining ends of the rectangular shaped spring member and knobs provided at ends of the rectangular shaped spring member, the cut and knobs are configured to allow the rectangular shaped spring member to pass through said combining cylindrical portion such that outer peripheral portions of the rectangular shaped spring member fit in said annular groove, whereby said rectangular shaped spring member is latched with said combining cylindrical portion such that said rectangular shaped spring member elastically presses said second lens from the rear side while holding said hood rotatably and unmovably in the back-and-forth direction, and the degree of diffusion of light incident from the rear surface side of the second lens, that is diffused and radiated from a front surface of the second lens, is larger in a direction orthogonal to a direction in which the plurality of rows of recessed portions extend, than in the direction in which the plurality of rows of recessed portions extend.

2. The illumination device according to claim 1, wherein said second lens has an unevenly profiled portion provided with a number of quadrangular pyramid-shaped recessed portions on the front surface.

3. The illumination device according to claim 1, wherein the illumination device further comprises:

a substrate for fixing said plurality of multi-color light emitting diodes in a same plane such that each of said plurality of multi-color light emitting diodes faces toward a front of the illumination device;

a body for covering the sides of said plurality of multi-color light emitting diodes and said substrate;

a heat sink disposed on the rear side of said substrate for dissipating the heat of said plurality of multi-color light emitting diodes; and a support bracket for supporting said plurality of first lenses while fixing the same to said substrate.

4. The illumination device according to claim 3, wherein each of said plurality of multi-color light emitting diodes comprises a plurality of LED chips with different light emission colors, wherein at least one multi-color light emitting diode of the plurality of multi-color light emitting diodes is rotated by a prescribed angle with reference to one other multi-color light emitting diode such that when translating said one multi-color light emitting diode so as to overlap with said one other multi-color light emitting diode, LED chips having the same light emission color do not overlap with each other.

5. The illumination device according to claim 4, wherein said plurality of multi-color light emitting diodes include four multi-color light emitting diodes that are provided on a same circumference of the substrate at regular intervals, each of the multi-color light emitting diodes having LED chips with four colors of red, green, blue and white disposed on the same circumference of the substrate at regular intervals, and each of the multi-color light emitting diodes is rotated by 90 degrees with respect to the circumferentially adjoining multi-color light emitting diodes.

* * * * *